US005145591A

United States Patent [19]

Kinoshita et al.

[11] Patent Number: 5,145,591

[45] Date of Patent: Sep. 8, 1992

[54] DIUREA GREASE COMPOSITION

[75] Inventors: Hirotugu Kinoshita, Kawasaki; Makoto Sekiya, Takarazuka; Masaru Mishima, Kawasaki, all of Japan

[73] Assignee: Nippon Oil Co., Ltd., Tokyo, Japan

[21] Appl. No.: 547,880

[22] Filed: Jul. 3, 1990

[30] Foreign Application Priority Data

Jul. 7, 1989 [JP] Japan ..... 1-174084

[51] Int. Cl.[5] ..... C10M 115/08; C10M 133/20

[52] U.S. Cl. ..... 252/51.5 R; 252/51.5 A

[58] Field of Search ..... 252/51.5 R

[56] References Cited

U.S. PATENT DOCUMENTS

| | | | |
|---|---|---|---|
| 4,065,395 | 12/1977 | Bailey | 252/51.5 A |
| 4,100,081 | 7/1978 | Dreher et al. | 252/51.5 A |
| 4,263,156 | 4/1981 | Caruso | 252/51.5 A |
| 4,529,530 | 7/1985 | Shimizu et al. | 252/51.5 A |
| 4,668,411 | 5/1987 | Yasui et al. | 252/51.5 A |
| 4,780,231 | 10/1988 | Kinoshita et al. | 252/51.5 A |
| 4,915,860 | 4/1990 | Kinoshita et al. | 252/51.5 A |

*Primary Examiner*—Ellen McAvoy
*Attorney, Agent, or Firm*—Darby & Darby

[57] ABSTRACT

A diurea grease composition contains a base oil and 2 to 25 wt.%, based on the total weight of the composition, of a diurea compound, the diurea grease compound being produced by reacting a mixed system of two or more different diisocyanates represented by the formula (I) OCN—R—NCO wherein R stands for a straight-chained or branched alkylene group, a straight-chained or branched alkenylene group, a cycloalkylene group or an aromatic group, with an amine compound selected from the group consisting of a primary amine represented by the formula (II) $R_1$—$NH_2$ wherein $R_1$ stands for a hydrocarbon residue having 6 to 20 carbon atoms, a secondary amine represented by the formula (III)

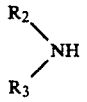

wherein $R_2$ and $R_3$ each stand for hydrocarbon residues having 6 to 20 carbon atoms, and mixtures thereof.

19 Claims, No Drawings

DIUREA GREASE COMPOSITION

BACKGROUND OF THE INVENTION

This invention relates to a diurea grease composition. More particularly, it relates to a diurea grease composition which undergoes little changes in consistency after use at higher temperatures for a prolonged period of time and small oil separation at higher temperatures and which is also superior in various other properties.

Up to now, metal soaps are predominantly employed as the grease thickeners. However, the lithium soap grease, known as the "universal grease", has a dropping point of the order of 200° C. or thereabouts and cannot be used at higher temperatures above 150° C.

On the other hand, various complex soaps, sodium terephthalamate, bentone or organic thickeners, such as indanthrene or urea have been proposed as high temperature long life grease thickeners. However, these thickeners suffer from certain demerits For example, a calcium complex type thickener tends to be hardened markedly with lapse of time. Sodium terephthalamate in general undergoes syneresis and oil separation considerably, while it tends to be deteriorated due to oxidation by reason of intramolecular metal atoms in the thickener. Bentone is inferior in lubricating properties at higher temperatures on prolonged usage, while indanthrene has a bad hue and is expensive.

On the other hand, urea greases, such as diurea grease or tetraurea greases having modified terminal groups, have many advantageous points as compared with the above mentioned greases. However, the tetraurea grease tends to be hardened or increased in consistency when exposed to higher temperatures for prolonged time period, while it may be disadvantageously hardened or softened depending on different shearing speeds given to the grease. The known diurea greases having only terminal alkyl groups have a low dropping point and undergoes considerable oil separation at higher temperatures so that they cannot be used for prolonged time at higher temperatures. The diurea greases having only aromatic hydrocarbon terminal groups are at most equivalent or even inferior to the diurea greases having the terminal alkyl groups with respect to the properties as the thickener.

The present inventors have conducted researches towards overcoming the above mentioned drawbacks of the urea greases and have found that, while the diurea compound has highly desirable properties as the thickener, the terminal groups of the diurea compound plays an extremely important role.

Specifically, it has been found that the diurea compound in which C-6 to C-12 cyclohexyl groups or its derivatives and C-8 to C-20 alkyl groups exist on either one of the terminal ends of the diurea compounds and in which the contents of the cyclohexyl groups or its derivatives are 20 to 90 mol percent based on the total amount of the two groups, exhibits extremely desirable properties as the grease thickener. This diurea compound has been applied for patent in our Japanese Patent Publication No. 11156/1980.

Ths diurea grease disclosed in the Japanese Patent Publication No. 11156/1980 has many excellent properties, such as i) little changes in consistency after prolonged use at higher temperatures;

ii) superior mechanical stability under a wide range of shearing speeds;

iii) small oil separation at higher temperatures;

iv) superior water resistance; and v) improved thickening properties.

A diurea grease composition exhibiting extremely low hardening properties with lapse of time besides the above mentioned desirable properties has also been found and applied for patent in Japanese Patent Laid-open Application No. 250097/1987.

Also an urea grease containing two diurea compounds at predetermined ratios which are sandwitched between the terminal group and both urea groups and different with respect to the hydrocarbon groups, is disclosed in our Japanese Patent Application No. 139696/1989.

As a result of our further researches, the present inventors have found that a grease containing a diurea compound obtained by reacting an amine with a mixed system of two or more different diisocyanates exhibits superior properties. This finding has led to fulfilment of the present invention.

SUMMARY OF THE INVENTION

It is a principal object of the present invention to provide a diurea grease composition which undergoes little changes in consistency after use at higher temperatures for prolonged time and small oil separation at higher temperatures, and which is also superior in other various properties.

The above and other objects of the present invention will become apparent from the following description.

In acordance with the present invention ,there is provided a diurea grease composition comprising a base oil and 2 to 25 wt.%, based on the total weight of the composition, of a diurea compound as an essential ingredient, the diurea grease compound being produced by reacting a mixed system of two or more different diisocyanates represented by the formula (I )

$$\text{OCN—R—NCO} \qquad \text{(I)}$$

wherein R stands for a straight-chained or branched alkylene group, a straight-chained or branched alkenylene group, a cycloalkylene group or an aromatic group, with an amine compound selected from the group consisting of a primary amine represented by the formula (II)

$$R_1\text{—}NH_2 \qquad \text{(II)}$$

wherein $R_1$ stands for a hydrocarbon residue having 6 to 20 carbon atoms, a secondary amine represented by the formula (III)

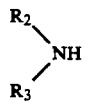

(III)

wherein $R_2$ and $R_3$ may be the same or different and each stand for hydrocarbon residues having 6 to 20 carbon atoms, and mixtures thereof.

PREFERRED EMBODIMENTS OF THE INVENTION

The present invention will be explained in more detail hereinbelow.

As the base oils, any oils commonly used as the lube base oil may be employed As mineral lube base oils, mineral oils refined by a method consisting in a suitable combination of distillation under reduced pressure, solvent deasphalting, solvent extraction, hydrocracking, solvent dewaxing, hydrogenative dewaxing, washing by sulfuric acid, refining by terra abla or hydrofining.

As synthetic lube oils, α-olefin oligomers, such as normal paraffins, isoparaffins, polybutene, polyisobutyrene or 1-decene oligomers, alkylbenzenes such as monoalkylbenzene, dialkylbenzene or polyalkylbenzene, alkyl naphthalenes, such as monoalkyl naphthalene, dialkyl naphthalene or polyalkyl naphthalene, diesters such as di-2-ethylhexyl sebacate, dioctyl adipate, diisodecyl adipate, ditridecyl adipate or ditridecyl glutarate, polyol esters such as trimethylolpropane caprylate, trimethylolpropane pelargonate, pentaerithritol-2-ethyl hexanoate or pentaerithritol pelargonate, polyglycols such as polyethylene glycol, polyethylene glycol monoether, polypropylene glycol or polypropylene glycol monoether, polyphenyl ethers, tricresyl phosphate, silicone oils or perfluoroalkyl ethers, may be employed. Two or more of the above mentioned oils may also be employed as a mixture. The desirable viscosity range of these base oils is 2 to 2000 cSt at 100° C.

The diurea compound as the essential ingredient of the composition of the present invention may be obtained by reacting a mixed system of two or more different diisocyanates represented by the formula (I)

$$OCN—R—NCO \quad (I)$$

wherein R stands for a straight-chained or branched alkylene group, a straight-chained or branched alkenylene group, a cycloalkylene group or an aromatic group, with an amine compound selected from the group consisting of a primary amine represented by the formula (II)

$$R_1—NH_2 \quad (II)$$

wherein $R_1$ stands for a straight-chained or branched alkylene group, a straight-chained or branched alkenylene group, a (II)

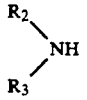

(III)

wherein $R_2$ and $R_3$ may be the same or different and each stand for hydrocarbon residues having 6 to 20 carbon atoms, and mixtures thereof.

The number of carbon atoms in the group R in the isocyanate represented by the formula (I) may preferably be 6 to 20 and more preferably 6 to 15. The aforementioned mixed system of the diisocyanates preferably include mixtures of two or more compounds selected from the group consisting of, for example, diphenylmethane-4, 4'-diisocyanate, tolylene diisocyanate, hexamethylene diisocyanate, 2, 2, 4-trimethyl-hexamethylene diisocyanate, p-phenylene diisocyanate, 4, 4'-dicyclohexylmethane diisocyanate, 3, 3'-dimethyldiphenyl-4, 4'-diisocyanate, m-xylene diisocyanate, m-tetramethylxylene diisocyanate, p-tetramethylxylene diisocyanate, isophorone diisocyanate, 1, 5-naphthalene diisocyanate and trans-1, 4-cyclohexyl diisocyanate. More specifically, it may include a mixed system of diphenylmethane-4, 4'-diisocyanate and 4, 4'-dicyclohexylmethane diisocyanate, a mixed system of diphenylmethane-4, 4'-diisocyanate and 3, 3'-dimethyldiphenyl-4, 4'-diisocyanate, a mixed system of diphenylmethane-4, 4'-diisocyanate and m-xylenediisocyanate, a mixed system of diphenylmethane-4, 4'-diisocyanate and tetramethylxylene diisocyanate, a mixed system of diphenylmethane-4, 4'-diisocyanate and a mixture of 2, 4-tolylene diisocyanate and 2, 6-tolylene diisocyanate, a mixed system of diphenylmethane-4, 4'-diisocyanate and isophorone diisocyanate, a mixed system of 3, 3'-dimethyldiphenyl-4,4'-diisocyanate and m-xylene diisocyanate, a mixed system of 3, 3'-dimethyldiphenyl-4, 4'-diisocyanate and tetramethylxylene diisocyanate, a mixed system of 3, 3'-dimethyldiphenyl-4, 4'-diisocyanate and a mixture of 2, 4-tolylene diisocyanate and 2, 6-tolylene diisocyanate, a mixed system of 3, 3'-dimethyldiphenyl-4, 4'-diisocyanate and hexamethylene diisocyanate, a mixed system of m-xylene diisocynate and tetramethylxylene diisocyanate, a mixed system of m-xylene diisocyanate and a mixture of 2, 4-tolylene diisocyanate and 2,6-tolylene diisocyanate, a mixed system of m-xylene diisocyanate and hexamethylene diisocyanate, a mixed system of tetramethylxylene diisocyanate and a mixture of 2, 4-tolylene diisocyanate and 2, 6-tolylene diisocyanate, a mixed system of tetramethylxylene diisocyanate and isophorone diisocyanate, and a mixed system of a mixture of 2, 4-tolylene diisocyanate and 2, 6-tolylene diisocyanate and hexamethylene diisocyanate.

The mixing ratios of the above mentioned two or more different diisocyanates may be suitably selected in dependence upon the structures of the diisocyanates and the consistency of the greases to be produced. However, when mixing two different diisocyanates, the mixing ratio may usually be 5–95 : 95–5, preferably 10–90 : 90–10, more preferably 20–80 : 80–20 and most preferably 30–70 : 70–30, in terms of the mol percent ratio. The mixing ratio less than the range of 5–95 : 95–5 is not desirable since problems are raised in changes in consistency after use or in oil separation so that the properties of the grease thickener are lowered. More specifically, with the mixed system of diphenylmethane-4, 4'-diisocyanate represented by the formula

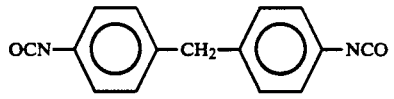

and tolylene diisocyanate represented by the formula

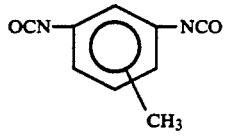

the mixing ratio is preferably 10 to 95 mol percent, preferably 20 to 80 mol percent and most preferably 30 to 70 mol percent of diphenylmethane-4, 4'-diisocyanate and 5 to 90 mol percent, preferably 20 to 80 mol percent and most preferably 30 to 70 mol percent of tolylene diisocyanate. When using three or more diisocyanates, the respective diisocyanates are preferably contained in amounts of not less than 5 mol percent and preferably not less than 10 mol percent.

According to the present invention, the amine compound reacted with the mixed diisocyanate system is a primary amine, a mixture of two or more primary amines, a secondary amine, or a mixture of two or more different secondary amines, represented by the above formulas (II) and (III), or mixtures thereof. In the above formulas (II) and (III), $R_1$, $R_2$ and $R_3$ may be the same or different groups and denote hydrocarbon residues with 6 to 20 caron atoms. As these hydrocarbon residues, various groups such as alkyl, alkenyl, cycloalkyl or aromatic groups, may be employed. The alkyl groups may include those with straight or branched chains, such as hexyl, heptyl, octyl, nonyl, decyl, undecyl, dodecyl, tridecyl, tetradecyl, pentadecyl, hexadecyl, heptadecyl, octadecyl, nonadecyl or eicosyl groups.

The alkenyl groups may include those with straight or branched chains, such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl or eicosenyl groups.

As the cycloalkyl groups, cyclohexyl group and the groups derived from the cyclohexyl group may preferably be employed. Examples of the cyclohexyl group and its derivatives may include cyclohexyl, methyl cyclohexyl, dimethyl cyclohexyl, ethyl cyclohexyl, diethyl cyclohexyl, propyl cyclohexyl, isopropyl cyclohexyl, 1-methyl-3-propylcyclohexyl, butyl cyclohexyl, amyl cyclohexyl, amylmethyl cyclohexyl, hexyl cyclohexyl, heptyl cyclohexyl, octyl cyclohexyl, nonyl cyclohexyl, decyl cyclohexyl, undecyl cyclohexyl, dodecyl cyclohexyl, tridecyl cyclohexyl and tetradecyl cyclohexyl groups. Most desirable are a cyclohexyl group and C7 to C8 groups derived from the cyclohexyl group, such as, for example, methyl cyclohexyl, dimethyl cyclohexyl or ethyl cyclohexyl groups.

Examples of the aromatic groups may include phenyl, toluyl, benzyl, ethyl phenyl, methyl benzyl, xylyl, propyl phenyl, cumenyl, ethyl benzyl, methyl phenetyl, butyl phenyl, propyl benzyl, ethyl phenetyl, pentyl phenetyl, butyl benzyl, propyl phenetyl, hexyl phenyl, pentyl benzyl, butyl phenetyl, heptyl phenyl, hexyl benzyl, pentyl phenetyl, octyl phenyl, heptyl benzyl, hexyl phenetyl, nonyl phenyl, octyl benzyl, heptyl phenetyl, decyl phenyl, nonyl benzyl, octyl phenetyl, undecyl phenyl, decyl benzyl, nonyl phenetyl, dodecyl phenyl, undecyl benzyl, decyl phenetyl, tridecyl phenyl, dodecyl benzyl, undecyl phenetyl, tetradecyl phenyl, tridecyl benzyl, dodecyl phenetyl, naphtyl, methyl naphtyl, ethyl naphtyl, propyl naphtyl, butyl naphtyl, pentyl naphtyl, hexyl naphtyl, heptyl naphtyl, octyl naphtyl, nonyl naphtyl and decyl naphtyl groups.

The most preferred amine compound to be reacted with the above mentioned diisocyanate mixed system is a primary amine represented by the formula (II) in which $R_1$ denotes a cyclohexyl group, a C7 to C12 alkylcyclohexyl group, a C 6 to C20 alkyl group or a C6 to C20 alkenyl group, or a secondary amine represented by the formula (III) in which $R_2$ and $R_3$ each denote a cyclohexyl group or a C7 to C12 alkylcyclohexyl group. Most preferred is also an amine mixture in which the primary amine represented by the formula (II) is used and in which the ratio of the total number of cyclohexyl groups and/or the alkyl cyclohexyl groups to the number of the total amines given by the formula {((total number of the cyclohexyl groups and/or the alkylcyclohexyl groups)/(the total number of the groups selected from the group consisting of the cyclohexyl group, alkylcyclohexyl group, alkyl group and the alkenyl group bonded to the amine employed)}×100 is 20 to 90 in terms of the mol percent. In this case, contents of the diurea compound containing both the cyclohexyl groups and/or alkylcyclohexyl groups and the alkyl groups and/or alkenyl groups in the produced diurea compound account for 10 mol percent or higher based on the total number of the produced diurea compounds. Also preferred is an amine mixture consisting of a primary amine of the formula (II) in which $R_1$ is a cyclohexyl group, a C7 to C12 alkyl cyclohexyl group or a C6 to C20 alkyl group and a secondary amine of the formula (III) in which $R_2$ and $R_3$ each represent a cyclohexyl group or a C7 to C12 alkyl cyclohexyl group and in which the ratio of the contents of the secondary amine to the amount of total amine given by the formula {(number of amino groups in the secondary amine)/(number of the amino groups in the primary amine plus number of the amino groups in the secondary amine)}×X 100 is 1 to 50 in terms of mol percent, or an amine mixture in which the total amount of the primary amine of the formula (II) in which $R_1$ is a cyclohexyl group or an alkylcyclohexyl group bears a molar ratio of ¼ to 4/1 with respect to the primary amine of the formula (II) in which $R_1$ is an alkyl group. By using these preferred amine mixtures, the hardening properties of the diurea grease composition with lapse of time according to the present invention may be diminished significantly.

With the diurea grease composition of the present invention, the diurea compound, acting as the thickener, is produced by reacting the above mentioned mixed system of the diisocyanates with the above mentioned primary amine and/or secondary amine. This point is most crucial in the present invention. The effects of the present invention cannot be derived from the diurea grease obtained in any other methods, such as by separately reacting the above mentioned two or more diisocyanates with amines and subsequently mixing the produced two or more diurea compounds.

When the above mentioned mixed system of diisocyanates is reacted with the above mentioned primary amine and/or the secondary amine, volatile solvents, such as benzene, toluene, xylene, hexane, naphtha, diisobutyl ether, carbon tetrachloride or petroleum ether, may be employed. Lube base oils may also be employed as suitable solvents. The preferred reaction temperature is 100° to 200° C. The reaction system need be mixed and agitated thoroughly to produce a uniform diurea grease.

The thus produced diurea compound, acting as the thickener, contains the diurea compounds in amounts corresponding to the mixing ratios of the diisocyanates. More specifically, if the mixed system consisting of 10 to 95 mol percent of diphenylmethane-4,4'-diisocyanate and 5 to 95 mol percent of tolylene diisocyanate is employed, the thickener contains 10 to 95 mol percent of a diure compound represented by the formula

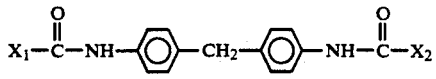

and 5 to 90 mol percent of a diurea compound represented by the formula

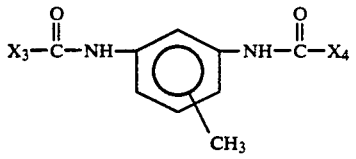

wherein $X_1$, $X_2$, $X_3$ and $X_4$ each stand for one of the groups

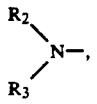

where $R_1$, $R_2$ and $R_3$ have the same meaning as $R_1$, $R_2$ and $R_3$ in the above formulas (II) and (III). When the volatile solvent is used, the solvent is removed and a suitable amount of the lube base oil is added to give the grease. When the lube base oil is used as the solvent, the reaction product may be used directly as the grease.

With the diurea grease composition of the present invention, the contents of the diurea compound acting as the thickener is 2 to 25 wt.% and preferably 3 to 20 wt.% based on the total weight of the composition. The contents of the diurea compound less than 2 wt.% are not desirable because the effects as the thickener are nill, whereas the contents in excess of 25 wt.% are also not desirable because the grease becomes too hard and cannot exhibit the lubricating effects sufficiently.

The grease of the present invention may be admixed with suitable additives for further improving its properties. These aditives amy include other thickeners, such as metal soaps, bentone or silica gel, extreme pressure agents, such as chlorine, sulphur or phosphorus extreme pressure agents or zinc dithiophosphate, oiliness agents such as fatty oils, animal or vegetable oils, viscosity index improvers, such as polymethacrylate, polybutene or polystyrene, anti-oxidants such as amine, phenol or sulpher anti-oxidants or zinc dithiophosphate, or metal inactivators, such as benzotriazole or thiadiazole.

EXAMPLES OF THE INVENTION

The present invention will be explained in more detail with reference to certain Examples and Comparative Examples.

EXAMPLE 1

30.5 g of diphenylmethane-4, 4'-diisocyanate and 21.2 g of tolylene diisocyanate were charged into 895 g of mineral oil having a viscosity at 100° C. of 10.3 cST and heated to 60° C. so as to be dissolved uniformly therein. 48.3 g of cyclohexylamine were added and agitated vigorously. In this manner, a gel-like substance was produced immediately. This substance was maintained under sustained agitation at 100° C. for 30 minutes. 5 g of an anti-oxidant was added and the resulting mixture was agitated thoroughly. The mixture was then passed through a roll mill to produce a grease composition. The produced diurea compound was formed by 50 mol percent of the diurea compound represented by the formula

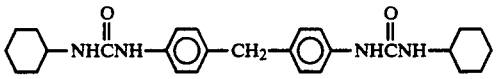

and 50 mol percent of the diurea compound represented by the formula

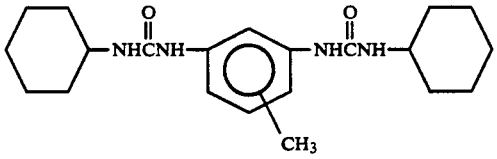

The contents in the composition of the thickener formed by the diurea compound were 10 wt.%.

The following performance evaluating tests were conducted on the produced grease. The results are shown in Table 1.

Tests for Evaluation of the Performance

As the consistency, the unworked consistency (UW) and the worked consistency (60W and $10^5$W) were masured in accordance with the consistency testing method according to ASTM 217.

The dropping point was measured in accordance with the dropping point testing method in JIS K 2220 5.4.

The oil separation was measured at 150° C. for 200 hours in accordance with the oil separation testing method in JIS K 2220 5.7.

EXAMPLE 2

32.7 g of diphenylmethane-4, 4'-diisocyanate and 5.7 g of tolylene diisocyanate were charged into 600 g of mineral oil having a viscosity at 100° C. of 10.3 cSt and heated to 60° C. so as to be dissolved uniformly therein. To this solution was added a solution obtained by mixing and dissolving 44.1 g of octadecylamine and 17.5 g of p-toluidine in 300 g of dioctyl sebacate and the resulting mixture was agitated vigorously. In this manner, a gell-like substance was produced immediately. After the agitation was continued further so that the temperature of the gell-like substance was raised to 80° C., the substance was passed through a roll mill to produce a grease composition. The produced diurea compound was formed by 80 mol percent in total of diurea compounds represented by the formulas

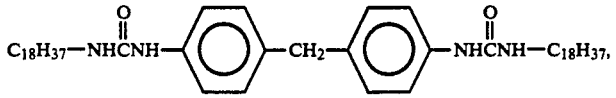

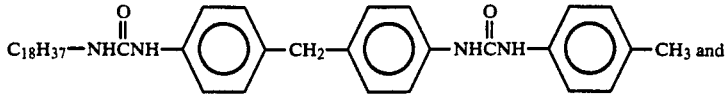

-continued

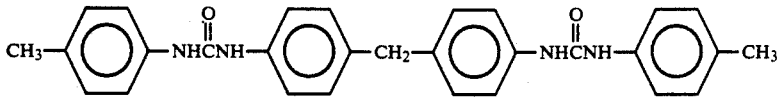

and 20 mol percent in total of diurea compounds represented by the formulas

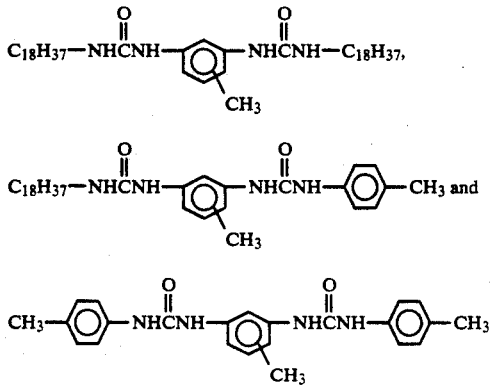

The contents in the composition of the thickener formed by the diurea compounds were 10 wt.%.

The performance evaluating tests similar to those in example 1 were conducted on the produced diurea grease. The results are shown in Table 1.

EXAMPLE 3

13.4 g of diphenylmethane-4, 4'-diisocyanate and 21.7 g of tolylene diisocyanate were charged into 900 g of low molecular polybutene having a viscosity at 100° C. of 23.5 cSt and were heated to 60° C. so as to be dissolved uniformly therein. To this solution were added 48.4 g of dicyclohexylamine and 16.5 g of laurylamine and agitated vigorously. A gel-like substance was produced immediately. After the agitation was continued for 30 minutes to raise the temperature to 120° C., the substance was passed through a roll mill to produce a grease composition. The produced diurea compound was formed by 30 mol percent in total of the diurea compounds represented by the formulas

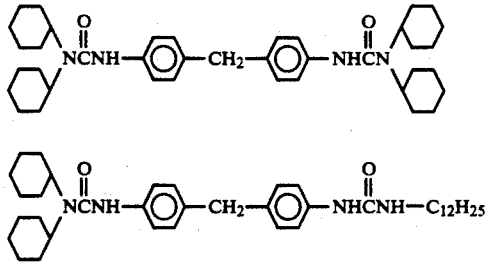

and

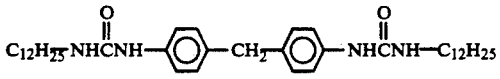

and 70 mol percent in total of the diurea compounds represented by the formulas

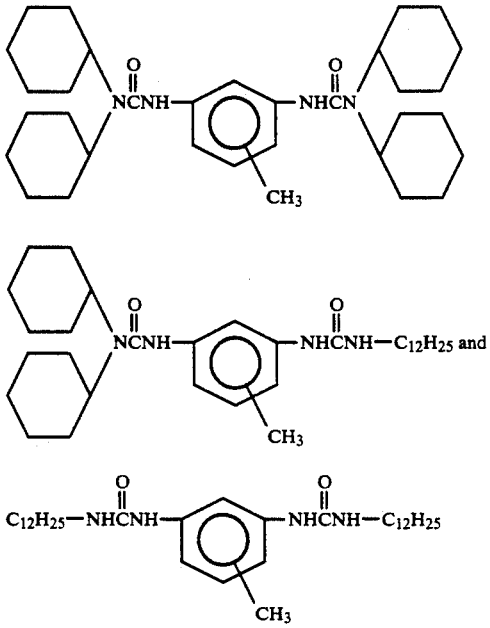

The contents in the composition of the thickener formed by the diurea compounds were 10 wt.%.

The performance tests similar to those in Example 1 were conducted on the produced diurea grease for evaluating the performance. The results are shown in Table 1.

EXAMPLE 4

25.3 g of diphenylmethane-4,4'-diisocyanate and 17.6 g of tolylene diisocyanate were charged into 600 g of a mineral oil having a viscosity at 100° C. of 31.5 cSt and were heated to 60° C. so as to be dissolved uniformly therein. To this solution was added a solution obtained by mixing and dissolving 20.0 g of cyclohexylamine and 37.1 g of laurylamine in 300 g of mineral oil and the resulting mixture was agitated vigorously. A gel-like sustance was produced immediately. After the agitation was continued to raise the temperature to 80° C., the substance was passed through a roll mill to produce a grease composition. The produced diurea compound was comprised of 50 mol percent in total of the diurea compounds represented by the formulas

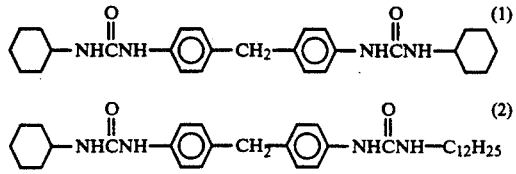

(1)

(2)

and

-continued

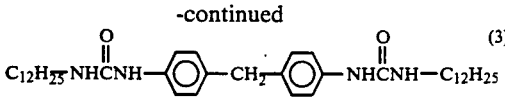

(3)

and 50 mol percent in total of the diurea compounds represented by the formulas

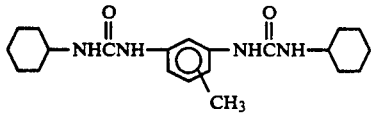

(4)

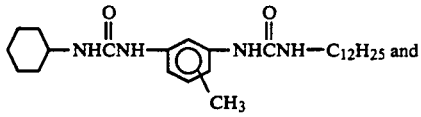

(5)

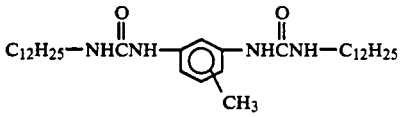

(6)

with the sum of the amounts of the compounds represented by the formulas (2) and (5) being 50 mol percent. The contents in the composition of the thickener formed by the diurea compounds were 10 wt.%.

The performance evaluating tests similar to those in Example 1 were conducted on the produced diurea grease. The results are shown in Table 1.

EXAMPLE 5

15.3 g of diphenylmethane-4, 4'-diisocyanate and 24.9 g of tolylene diisocyanate were charged into 600 g of a synthetic hydrocarbon oil having a viscosity at 100° C. of 8.2 cSt and heated to 60° C. so as to be dissolved uniformly therein. To this solution was added a solution obtained by mixing and dissolving 32.9 g of octadecylamine, 12.1 g of cyclohexylamine and 14.8 g of dicyclohexylamine in 300 g of synthetic hydrocarbon oil and the resulting mixture was agitated vigorously. A gel-like sustance was produced immediately. After the agitation was continued to raise the temperature to 80° C., the substance was passed through a roll mill to produce a grease composition. The produced diurea compound was formed by 30 mol percent of a diurea compound represented by the formula

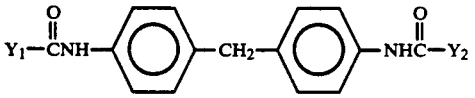

and 70 mol percent of a diurea compound represented by the formula

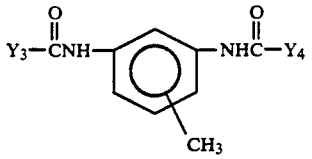

where $Y_1$, $Y_2$, $Y_3$ and $Y_4$ each stand for groups

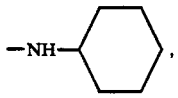

—NH—$C_{18}H_{37}$ or

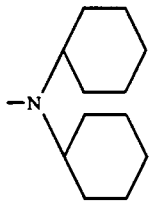

at a rate of 30 : 30 : 40. The contents in the composition of the thickener formed by the diurea compounds were 10 wt.%. The performance appraisal tests similar to those of Example 1 were conducted on the produced diurea grease. The results are shown in Table 1.

EXAMPLE 6

22.9 g of diphenylmethane-4, 4'-diisocyanate and 24.0 g of tolylene diisocyanate were charged into 600 g of polyphenyl ether having a viscosity at 100° C. of 13.0 cSt and were heated to 60° C. so as to be dissolved uniformly therein. To this solution was added a solution of 35.3g of methylcyclohexylamine and 17.8 g of octylamine in 295 g of polyphenyl ether and agitated vigorously. A gel-like substance was produced immediately. This substance was maintained at 100° C. for 30 minutes under sustained agitation and admixed with 5 g of an anti-oxidant. The resulting mixture was agitated thoroughly and passed through a roll mill to produce a grease composition. This diurea compounds were formed by 40 mol percent in total of diurea compounds represented by the formulas

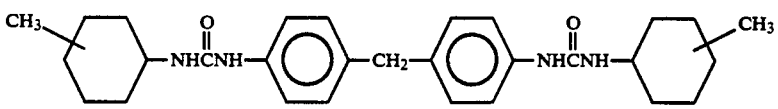

(7)

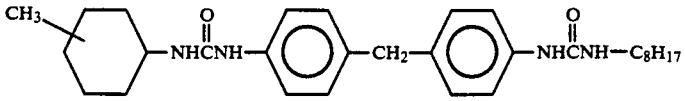

(8)

and

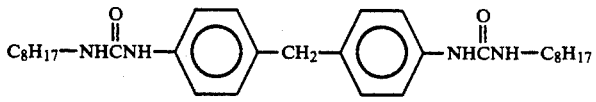

and 60 mol percent in total of diurea compounds represented by the formulas

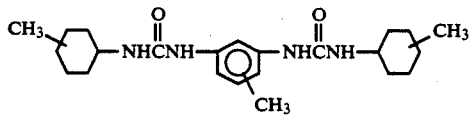

(10)

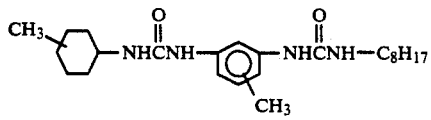

(11)

and

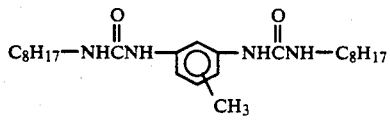

(12)

wherein the sum of the amounts of the compounds represented by the formulas (8) and (11) is 30 mol percent and the ratio of the contents of the methylcyclohexyl group and the octyl group is 70 : 30. The contents in the composition of the thickener formed by the diurea compounds were 10 wt.%.

The performance appraisal tests similar to those of Example 1 were conducted on the produced diurea grease. The results are shown in Table 1.

EXAMPLE 7

23.4 g of diphenylmethane-4, 4'-diisocyanate and 10.8 g of tolylene diisocyanate were charged into 600 g of polyglycol having a viscosity at 100° C. of 11.3 cSt and were heated to 60° C. so as to be dissolved uniformly therein. To this solution was added a solution of 37.0 g of eicosylamine, 11.9 g of dimethylcyclohexylamine and 16.9 g of dicyclohexylamine in 300 g of polyglycol and agitated vigorously. A gel-like substance was produced immediately. This substance was raised to a temperature of 80° C. by sustained agitation and passed through a roll mill to produce a grease composition. The produced diurea composition was formed by 60 mol percent of a diurea compound represented by the formula

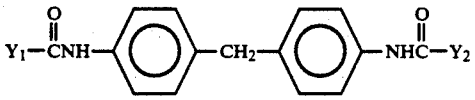

and 40 mol percent of a diurea compound represented by the formula

-continued (9)

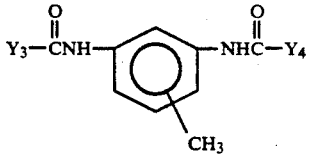

wherein $Y_1$, $Y_2$, $Y_3$ and $Y_4$ each represent groups

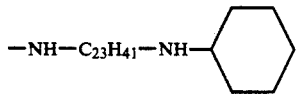

or

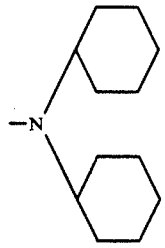

at the ratio of 40 : 30 : 30. The contents in the composition of the thickener formed by the diurea compounds were 10 wt.%.

The performance appraisal tests similar to those of Example 1 were conducted on the produced diurea grease. The results are shown in Table 1.

EXAMPLES 8 to 11

Diisocyanates A and B each shown in the following Table were charged into 900 g of a mineral oil having a viscosity at 100° C. of 10.3 cSt and were heated to 60° C. so as to be uniformly dissolved therein. To this solution was added cyclohexylamine in amounts respectively shown in the Table and agitated vigorously. Each of gel-like substances was produced immediately. After the temperature was raised to 120° C. by sustained agitation for 30 minutes, each substance was passed through a roll mill to produce a grease composition. The contents in the composition of the thickener formed by the diurea compounds were 10 wt.%, respectively.

The performance appraisal tests similar to those of Example 1 were conducted on the produced diurea greases. The results are shown in Table 1.

TABLE

| Example | 8 | 9 | 10 | 11 |
|---|---|---|---|---|
| Diisocyanate A | MDI | TODI | MDI | TODI |
| (g) | 30.0 | 29.2 | 7.3 | 31.9 |
| Diisocyanate B | XDI | TMXDI | IPDI | HDI |
| (g) | 22.5 | 27.0 | 3.1 | 20.3 |
| Cyclohexyl | 47.5 | 43.8 | 9.6 | 47.8 |

TABLE-continued

| Example | 8 | 9 | 10 | 11 |
|---|---|---|---|---|
| amine (g) | | | | |

Notes: The molar ratio of diisocyanate A to diisocyanate B is 50:50.
The abbreviations used in the above Table denote the following:
MDI: 4, 4'-diphenylmethane diisocyanate
XDI: m-xylene diisocyanate
TODI: 3, 3'-dimethyldiphenyl-4, 4'-diisocyanate
TMXDI: tetramethylxylene diisocyanate
IPDI: iophorone diisocyanate
HDI: 1, 6-hexamethylene diisocyanate

COMPARATIVE EXAMPLES 1 and 2

For comparison, the performance appraisal tests similar to those of Example 1 were conducted on the commercially available urea greases. The results are shown in Table 1.

COMPARATIVE EXAMPLE 3

55.8 g of diphenylmethane-4, 4'-diisocyanate were charged into 895 g of mineral oil having a viscosity at 100° C. of 10.3 cSt, and were heated to 60° C. so as to be uniformly dissolved therein. 44.2 g of cyclohexylamine were added to the solution and agitated vigorously. A gel-like substance was formed immediately. This substance was maintained at 100° C. for 30 minutes under continued agitation and admixed with 5.0 g of an anti-oxidant. The resulting mixture was agitated thoroughly and passed through a roll mill to produce a grease.

The contents of the diurea compound of the formula

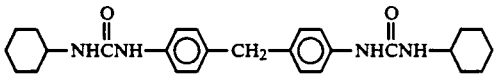

acting as the thickener were 10 wt.%.

The performance tests similar to those of Example 1 were conducted on the produced diurea grease. The results are shown in Table 1.

COMPARATIVE EXAMPLE 4

46.8 g of tolylene diisocyanate were charged into 895 g of mineral oil having a viscosity at 100° C. of 10.3 cSt and dissolved therein. 53.2 g of cyclohexylamine were added to the solution and agitated vigorously. A gel-like substance was formed immediately. This substance was maintained at 100° C. for 30 minutes under continued agitation and admixed with 5.0 g of an anti-oxidant. The resulting mixture was agitated thoroughly and passed through a roll mill to produce a grease.

The contents of the diurea compound of the formula

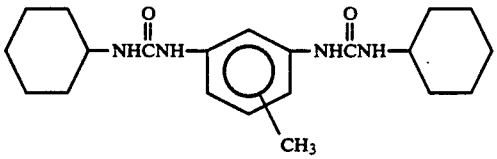

acting as the thickener were 10 wt.%.

The performance tests similar to those of Example 1 were conducted on the produced diurea grease. The results are shown in Table 1.

COMPARATIVE EXAMPLE 5

30.5 g of diphenylmethane-4, 4'-diisocyanate were charged into 450 g of mineral oil having a viscosity at 100° C. of 10.3 cSt, and were heated to 60° C. so as to be uniformly dissolved therein. 24.1 g of cyclohexylamine were added to the solution and agitated vigorously. A gel-like substance was formed immediately. This substance was maintained at 100° C. for 30 minutes under continued agitation and admixed with 5.0 g of an anti-oxidant. The resulting mixture was agitated thoroughly and passed through a roll mill. Separately, 21.2 g of tolylene diisocyanate were charged into 445 g of the same mineral oil and dissolved therein. 24.2 g of cyclohexylamine were added to the solution and agitated vigorously. A gel-like substance produced immediately was maintained at 100° C. for 30 minutes under continued agitation and passed through a roll mill. The two produced greases were agitated together uniformly to produce a grease composition. The diurea composition was formed by 50 mol percent of a diurea compound represented by the formula

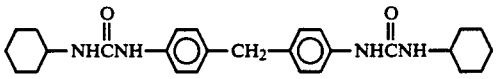

and 50 mol percent of a diurea compound represented by the formula

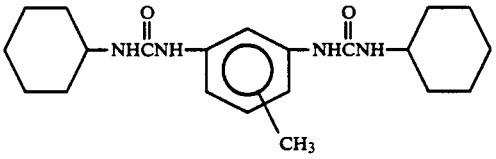

The contents in the composition of the thickener formed by the diurea compounds were 10 wt.%.

The performance tests similar to those of Example 1 were conducted on the produced diures grease. The results are shown in Table 1.

As may be seen from the results of the performance evaluation tests shown in Table 1, the diurea grease composition of the present invention has an improved shearing stability and a high dropping point while being subject to small oil separation and exhibiting superior thickening properties. On the other hand, the grease compositions of the Comparative Examples 1 to 5 are equivalent or inferior to the inventive grease composition in shearing stability and dropping point while being evidently inferior to the inventive grease in thickening properties and oil separation at higher temperatures. In the light of the above, the grease composition of the present invention is superior in its various properties to the compositions of the Comparative Examples 1 to 5.

TABLE 1

| | Thickener | ASTM Consistency | | | Dropping Point | Oil Separation (150° C., 200 h) |
|---|---|---|---|---|---|---|
| | Contents (wt. %) | UW | 60W | $10^5$W | °C. | wt. % |
| Ex. 1 | 10 | 250 | 253 | 299 | 275 | 2.5 |
| Ex. 2 | 10 | 265 | 266 | 301 | 282 | 3.2 |

TABLE 1-continued

| | Thickener Contents (wt. %) | ASTM Consistency UW | 60W | $10^5$W | Dropping Point °C. | Oil Separation (150° C., 200 h) wt. % |
|---|---|---|---|---|---|---|
| Ex. 3 | 10 | 255 | 259 | 285 | 291 | 1.7 |
| Ex. 4 | 10 | 242 | 247 | 288 | 282 | 0.6 |
| Ex. 5 | 10 | 247 | 253 | 290 | 295 | 1.5 |
| Ex. 6 | 10 | 271 | 275 | 325 | 261 | 4.6 |
| Ex. 7 | 10 | 251 | 259 | 331 | 255 | 5.1 |
| Ex. 8 | 10 | 284 | 287 | 342 | 271 | 2.7 |
| Ex. 9 | 10 | 291 | 296 | 363 | 258 | 0.9 |
| Ex. 10 | 10 | 266 | 289 | 305 | 285 | 3.8 |
| Ex. 11 | 10 | 289 | 293 | 348 | 254 | 5.4 |
| Comp. Ex. 1 | 10 | 326 | 315 | 199 | 249 | 10.7 |
| Comp. Ex. 2 | 15 | 379 | 382 | 423 | 276 | 5.8 |
| Comp. Ex. 3 | 10 | 358 | 357 | 371 | 277 | 7.2 |
| Comp. Ex. 4 | 10 | 364 | 367 | 421 | 265 | 11.3 |
| Comp. Ex. 5 | 10 | 372 | 374 | 433 | 255 | 12.1 |

Although the present invention has been described with reference to the specific examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A diurea grease composition comprising a base oil and 2 to 25 wt.%, based on the total weight of the composition, of a diurea compound as an essential ingredient, said diurea grease compound being produced by reacting a mixed system of two or more different diisocyanates selected from the group consisting of diphenylmethane-4,4'-diisocyanate, tolylene diisocyanate, hexamethylene diisocyanate, 2,2,4-trimethylhexamethylene diisocyanate, p-phenylene diisocyanate, 4,4'-dicyclohexylmethane diisocyante, 3,3'-dimethyldiphenyl-4,4'-diisocyanate, m-xylene diisocyanate, m-tetramethylxylene diisocyanate, p-tetramethylxylene diisocyanate, diisophorone diisocyange, 1,5-naphthalene diisocyanate, trans-1,4-cyclohexyl diisocyanate, and mixture thereof, with an amine compound selected from the group consisting of a primary amine represented by the formula (II)

$$R_1—NH_2 \quad (II)$$

wherein $R_1$ stands for a hydrocarbon residue having 6 to 20 carbon atoms, a secondary amine represented by the formula (III)

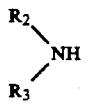

(III)

wherein $R_2$ and $r_3$ may be the same or different and each stand for hydrocarbon residues having 6 to 20 carbon atoms, and mixture thereof, wherein said grease composition has a reduced tendency to separate relative to a comparison composition derived from the same diisocyanate compounds and the same amine compounds as said grease composition, the comparison composition having the same proportion of the groups derived from the diisocyanate and amine compounds as said grease composition, but wherein the individual diurea compounds are separately admixed into the comparison composition.

2. The diurea grease composition according to claim 1 wherein said base oil is selected from the group consisting of mineral lube base oil, synthetic lube base oil and mixtures thereof.

3. The diurea grease composition according to claim 2 wherein said mineral lube base oil is a mineral oil selected from the group consisting of mineral oils by distillation under reduced pressure, solvent deasphalting, solvent extraction, hydrocracking, solvent dewaxing, hydrogenative dewaxing, washing by sulfuric acid, refining by terra abla and hydrorefining.

4. The diurea grease composition according to claim 2 wherein said synthetic lube base oil is selected from the group consisting of normal paraffins, isoparaffins, polybutene, polyisobutyrene, 1-decene oligomers, monoalkylbenzene, dialkylbenzene, polyalkylbenzene, monoalkyl naphthalene, dialkyl naphthalene, polyalkyl naphthalene, di-2-ethylhexyl sebacate, dioctyl adipate, diisodecyl adipate, ditridecyl adipate, ditridecyl glutarate, trimethylolpropane caprylate, trimethylolpropane pelargonate, pentaerithritol-2-ethyl hexanoate, pentaerithritol pelargonate, polyethylene glycol, polyethylene glycol monoether, polypropylene glycol, polypropylene glycol monoether, polyphenyl ethers, tricresyl phosphate, silicone oils, perfluoroalkyl ethers and mixtures thereof.

5. The diurea grease composition according to claim 1 wherein a viscosity of said base oil is 2 to 2000 cSt at 100° C.

6. The diurea grease composition according to claim 1 wherein number of carbon atoms of the group R in the formula (I) is 6 to 20.

7. The diurea grease composition according to claim 1 wherein said mixed system of the diisocyanates is selected from the group consisting of a mixed system of diphenylmethane-4, 4'-diisocyanate and 4, 4'-dicyclohexylmethane diisocyanate, a mixed system of diphenylmethane-4, 4'-diisocyanate and 3, 3'-dimethyldiphenyl-4, 4'-diisocyanate, a mixed system of diphenylmethane-4, 4'-diisocyanate and m-xylenediisocyanate, a mixed system of diphenylmethane-4, 4'-diisocyanate and tetramethylxylene diisocyanate, a mixed system of diphenylmethane-4, 4'-diisocyanate and a mixture of 2, 4-tolylene diisocyanate and 2, 6-tolylene diisocyanate, a mixed system of diphenylmethane-4, 4'-diisocyanate and isophorone diisocyanate, a mixed system of 3, 3'-dimethyldiphenyl-4,4'-diisocyanate and m-xylene diisocyanate, a mixed system of 3, 3'-dimethyldiphenyl-4, 4'-diisocyanate and tetramethylxylene diisocyanate, a mixed system of 3, 3'-dimethyldiphenyl-4, 4'-diisocyanate and a mixture of 2, 4-tolylene diisocyanate and 2, 6-tolylene diisocyanate, a mixed system of 3, 3'-dimethyldiphenyl-4, 4'-diisocyanate and hexamethylene diisocyanate, a mixed system of m-xylene diisocynate and tetramethylxylene diisocyanate, a mixed system of m-xylene diisocyanate and a mixture of 2, 4-tolylene diisocyanate and 2, 6-tolylene diisocyanate, a mixed system of m-xylene diisocyanate and hexamethylene diisocyanate, a mixed system of tetramethylxylene diisocyanate and a mixture of 2, 4-tolylene diisocyanate and 2, 6-tolylene diisocyanate, a mixed system of tetramethylxylene diisocyanate and isophorone diisocyanate, a mixed system of a mixture of 2, 4-tolylene diisocyanate and 2, 6-tolylene diisocyanate and hexamethylene diisocyanate, and mixtures thereof.

8. The diurea grease composition according to claim 1 wherein a mixing ratio of two different diisocyanates in said mixed system is 5–95 : 95–5 in terms of mol percent.

9. The diurea grease composition according to claim 1 wherein a mixing ratio of three or more different diisocyanates in said mixed system is such that the respective diisocyanates are contained in amounts of at least 5 mol percent.

10. The diurea grease composition according to claim 1 wherein the hydrocarbon residues $R_1$, $R_2$ and $R_3$ in said formulas (II) and (III) are selected from the group consisting of alkyl, alkenyl, cycloalkyl and aromatic groups.

11. The diurea grease composition according to claim 10 wherein said alkyl group is selected from the group consisting of hexyl, heptyl, octyl, nonyl, decyl, undecyl, dodecyl, tridecyl, tetradecyl, pentadecyl, hexadecyl, heptadecyl, octadecyl, nonadecyl and eicosyl groups.

12. The diurea grease composition according to claim 10 wherein said alkenyl groups is selected from the group consisting of hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl and eicosenyl groups.

13. The diurea grease composition according to claim 10 wherein said cycloalkyl group is selected from the group consisting of cyclohexyl, methyl cyclohexyl, dimethyl cyclohexyl, ethyl cyclohexyl, diethyl cyclohexyl, propyl cyclohexyl, isopropyl cyclohexyl, 1-methyl-3-propylcyclohexyl, butyl cyclohexyl, amyl cyclohexyl, amylmethyl cyclohexyl, hexyl cyclohexyl, heptyl cyclohexyl, octyl cyclohexyl, nonyl cyclohexyl, decyl cyclohexyl, undecyl cyclohexyl, dodecyl cyclohexyl, tridecyl cyclohexyl and tetradecyl cyclohexyl groups.

14. The diurea grease composition according to claim 10 wherein said aromatic group is selected from the group consisting of phenyl, toluyl, benzyl, ethyl phenyl, methyl benzyl, xylyl, propyl phenyl, cumenyl, ethyl benzyl, methyl phenetyl, butyl phenyl, propyl benzyl, ethyl phenetyl, pentyl phenetyl, butyl benzyl, propyl phenetyl, hexyl phenyl, pentyl benzyl, butyl phenetyl, heptyl phenyl, hexyl benzyl, pentyl phenetyl, octyl phenyl, heptyl benzyl, hexyl phenetyl, nonyl phenyl, octyl benzyl, heptyl phenetyl, decyl phenyl, nonyl benzyl, octyl phenetyl, undecyl phenyl, decyl benzyl, nonyl phenetyl, dodecyl phenyl, undecyl benzyl, decyl phenetyl, tridecyl phenyl, dodecyl benzyl, undecyl phenetyl, tetradecyl phenyl, tridecyl benzyl, dodecyl phenetyl, naphtyl, methyl naphtyl, ethyl naphtyl, propyl naphtyl, butyl naphtyl, pentyl naphtyl, hexyl naphtyl, heptyl naphtyl, octyl naphtyl, nonyl naphtyl and decyl naphtyl groups.

15. The diurea grease composition according to claim 1 wherein said amine compound is selected from the group consisting of an amine of the formula (II) wherein $R_1$ is a cyclohexyl group, an amine of the formula (II) wherein $R_1$ is an alkyl cyclohexyl group having 7 to 12 carbon atoms, an amine of the formula (II) wherein $R_1$ is an alkyl group having 6 to 20 carbon atoms, an amine of the formula (II) wherein $R_1$ is an alkenyl group having 6 to 20 carbon atoms, an amine of the formula (III) wherein $R_2$ and $R_3$ each represent a cyclohexyl group, an amine of the formula (III) wherein $R_2$ and $R_3$ each represent an alkyl cyclohexyl group having 7 to 12 carbon atoms, and mixtures thereof.

16. The diurea grease composition according to claim 1 wherein said amine compound is a mixture of primary amines of the formula (II) selected from the group consisting of cyclohexylamine, alkyl cyclohexylamine and mixtures thereof, with the sum of number of cyclohexylamine, alkyl cyclohexylamine and mixtures thereof accounting for 20 to 90 mol percent of number of total amines.

17. The diurea grease composition according to claim 1 wherein said amine compound is an amine mixture including a primary amine of the formula (II) in which $R_1$ is a group selected from the group consisting of a cyclohexyl group, a C7 to C12 alkylcyclohexyl group and a C6 to C20 alkyl group and a secondary amine of the formula (III) in which each of $R_2$ and $R_3$ is a group selected from the group consisting of a cyclohexyl group and a C7 to C12 alkyl cyclohexyl group, wherein contents of the secondary amine are 1 to 50 mol percent of the total amount of the amine compound, and wherein a total amount of the primary amine of the formula (II) in which $R_1$ is selected from the group consisting of a cyclohexyl group and an alkylcyclohexyl group bears a molar ratio of $\frac{1}{4}$ to 4/1 with respect to an amount of the primary amine of the formula (II) in which $R_1$ is an alkyl group.

18. The diurea grease composition according to claim 1 wherein the diurea compound having groups selected from the group consisting of a cyclohexyl group, an alkyl cyclohexyl group and mixtures thereof and the diurea compound having groups selected from the group consisting of an alkyl group, an alkenyl group and mixtures thereof are contained in an amount corresponding to not less than 10 mol percent of the total diurea compounds in the composition.

19. The diurea grease composition according to claim 1 wherein the mixed system of the diisocyanates is formed by 10 to 95 mol percent of diphenylmethane-4, 4'-diisocyanate represented by the formula

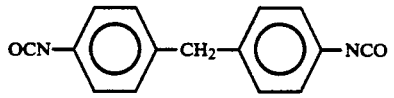

and 5 to 95 mol percent of tolylene diisocyanate represented by the formula

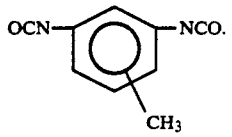

* * * * *